US011180980B2

(12) United States Patent
Wang et al.

(10) Patent No.: US 11,180,980 B2
(45) Date of Patent: Nov. 23, 2021

(54) DOWNHOLE OIL, GAS, WATER AND SAND SEPARATION METHOD AND SEPARATOR

(71) Applicants: PetroChina Company Limited, Beijing (CN); Daqing Oilfield Co., Ltd., Daqing (CN)

(72) Inventors: Yan Wang, Beijing (CN); Demin Wang, Beijing (CN); Rong Zhong, Beijing (CN); Quan Liu, Beijing (CN); Jintang Liu, Beijing (CN)

(73) Assignees: PetroChina Company Limited, Beijing (CN); Daqing Oilfield Co., Ltd., Daqing (CN)

( * ) Notice: Subject to any disclaimer, the term of this patent is extended or adjusted under 35 U.S.C. 154(b) by 224 days.

(21) Appl. No.: 16/482,842

(22) PCT Filed: Jan. 12, 2018

(86) PCT No.: PCT/CN2018/072424
§ 371 (c)(1),
(2) Date: Aug. 1, 2019

(87) PCT Pub. No.: WO2018/141199
PCT Pub. Date: Aug. 9, 2018

(65) Prior Publication Data

US 2020/0217187 A1 Jul. 9, 2020

(30) Foreign Application Priority Data

Feb. 3, 2017 (CN) ..... 201710063173.1

(51) Int. Cl.
*E21B 43/38* (2006.01)
*E21B 43/08* (2006.01)
(Continued)

(52) U.S. Cl.
CPC ..... *E21B 43/38* (2013.01); *E21B 33/126* (2013.01); *E21B 43/08* (2013.01); *E21B 43/121* (2013.01); *E21B 43/34* (2013.01)

(58) Field of Classification Search
CPC ..... E21B 43/38; E21B 43/34; E21B 43/121; E21B 33/126
See application file for complete search history.

(56) References Cited

U.S. PATENT DOCUMENTS 2,104,339 A * 1/1938 Arutunoff ..... E21B 43/38 166/105.1
4,241,788 A 12/1980 Brennan
(Continued)

FOREIGN PATENT DOCUMENTS

CN 1626770 A 6/2005
CN 2844437 Y 12/2006
(Continued)

OTHER PUBLICATIONS

First Office Action and search report dated Jul. 21, 2020 for counterpart Canadian patent application No. 3,049,491.
(Continued)

*Primary Examiner* — Yong-Suk (Philip) Ro
(74) *Attorney, Agent, or Firm* — Young Basile Hanlon & MacFarlane, P.C.

(57) ABSTRACT

A downhole oil, gas, water and sand separation method and separator (10). The downhole oil, gas, water and sand separation method comprises: step 1: dividing an oil jacket annulus into a plurality of spaces in an outflow direction of produced liquid, wherein each space is provided with an accommodating cavity (21) communicated with the oil jacket annulus; step 2: arranging a plurality of liquid inlet hole groups (11) in a liquid outlet pipeline (1) of the produced liquid in the outflow direction of the produced liquid, wherein each of the liquid inlet hole groups (11) is
(Continued)

communicated with one of the accommodating cavities (21); and step 3: separating oil, gas and water after the crude oil in the oil jacket annulus flows into each of the accommodating cavities (21), wherein separated oil drops or bubbles flow back to the oil jacket annulus from the accommodating cavities (21), and separated produced liquid simultaneously flows into the liquid outlet pipeline (1) through the plurality of liquid inlet hole groups (11). The downhole oil, gas, water and sand separation method and separator can realize a rapid downhole oil-water or gas-water separation in the high water-content crude oil.

24 Claims, 10 Drawing Sheets

(51) Int. Cl.

| | |
|---|---|
| ***E21B 43/12*** | (2006.01) |
| ***E21B 43/34*** | (2006.01) |
| ***E21B 33/126*** | (2006.01) |

(56) References Cited

U.S. PATENT DOCUMENTS

| | | | | |
|---|---|---|---|---|
| 5,711,374 | A | 1/1998 | Kjos | |
| 2014/0000872 | A1* | 1/2014 | Wang | B01D 17/0208 166/235 |
| 2019/0192243 | A1 | 6/2019 | Xu et al. | |

FOREIGN PATENT DOCUMENTS

| | | | |
|---|---|---|---|
| CN | 101377126 | A | 3/2009 |
| CN | 101773742 | A | 7/2010 |
| CN | 201943683 | A | 8/2011 |
| CN | 103071321 | A | 5/2013 |
| CN | 203321489 | U | 12/2013 |
| CN | 106801599 | A | 6/2017 |
| RU | 2077670 | C1 | 4/1997 |
| SU | 1601361 | A1 | 10/1990 |
| WO | 2012/119283 | A1 | 1/2014 |
| WO | 2018141199 | A1 | 8/2018 |

OTHER PUBLICATIONS

First Office Action and search report dated Apr. 17, 2020 for counterpart Russia patent application No. 2019121513, with English translation.

Decision for rejection dated Apr. 22, 2020 for counterpart Chinese patent application No. 201710063173.1, with the English translation.

International Search Report, dated Apr. 16, 2018, CN Application No. PCT/CN2018/072424.

First CN Office Action and Search Report, dated Sep. 5, 2018, CN Application No. 201710063173.1.

Second Office Action dated May 23, 2019 for counterpart Chinese patent application No. 201710063173.1 with machine EN translation downloaded from EPO.

Search Report dated Aug. 15, 2016 by China Patent Information Center.

Third Office Action dated Dec. 2, 2019 for counterpart Chinese patent application No. 201710063173.1 with machine EN translation downloaded from EPO.

* cited by examiner

DOWNHOLE OIL, GAS, WATER AND SAND SEPARATION METHOD AND SEPARATOR

TECHNICAL FIELD

The present disclosure relates to a separation method and a separator, in particular to a downhole oil, gas, water and sand separation method and a separator applied in the field of oil field development.

BACKGROUND ART

As the oil fields enter the high water-content production period, the emerging single well integral injection and production technique, and the gas-liquid separation technique needed to improve the pump efficiency, both require an efficient downhole oil-water or gas-water separation technique.

The existing downhole oil-water or gas-water separation device cannot effectively achieve the oil-water or gas-water separation and exploitation in the high water-content crude oil.

SUMMARY OF THE DISCLOSURE

An object of the present disclosure is to provide a downhole oil, gas, water and sand separation method, through which a downhole oil-water or gas-water separation can be rapidly performed in the high water-content crude oil.

Another object of the present disclosure is to provide a downhole oil, gas, water and sand separator, which can perform a downhole oil-water or gas-water separation rapidly in the high water-content crude oil.

The above objects of the present disclosure can be achieved by adopting the following technical solutions.

The present disclosure provides a downhole oil, gas, water and sand separation method, comprising:

step 1: dividing an oil jacket annulus into a plurality of spaces in an outflow direction of produced liquid, wherein each space is provided with an accommodating cavity communicated with the oil jacket annulus, so that crude oil in the oil jacket annulus is divided into a plurality of parts which flow into a plurality of accommodating cavities, respectively, a descending velocity of liquid in crude oil in each of the accommodating cavities is decreased relative to a descending velocity of liquid in the crude oil in the oil jacket annulus, and an ascending velocity of oil drops or bubbles in the crude oil in each of the accommodating cavities is increased relative to an ascending velocity of oil drops or bubbles in the crude oil in the oil jacket annulus;

step 2: arranging a plurality of liquid inlet hole groups in a liquid outlet pipeline of the produced liquid in the outflow direction of the produced liquid, wherein each of the liquid inlet hole groups is communicated with one of the accommodating cavities; and step 3: separating oil, gas and water after the crude oil in the oil jacket annulus flows into each of the accommodating cavities, wherein separated oil drops or bubbles flow back to the oil jacket annulus from the accommodating cavities, and separated produced liquid simultaneously flows into the liquid outlet pipeline through the plurality of liquid inlet hole groups; wherein the step 3 comprises:

determining pressure differences in the oil jacket annulus and the liquid outlet pipeline according to liquid production capacities of different oil wells, areas of different oil jacket annuluses, and an area of the liquid outlet pipeline; and adjusting open areas of the liquid inlet hole groups at different positions on the liquid outlet pipeline according to the pressure differences, so that flow rates of the produced liquid simultaneously flowing into the liquid outlet pipeline through each of the liquid inlet hole groups are equal.

The present disclosure further provides a downhole oil, gas, water and sand separator, comprising:

a liquid outlet pipeline provided with a plurality of liquid inlet hole groups spaced apart in an axial direction thereof; and a plurality of settling cups connected to each other and disposed around the liquid outlet pipeline, each having an accommodating cavity communicated with each of the liquid inlet hole groups, and having a liquid inlet;

wherein the settling cup comprises:

a cup body having a peripheral wall and a bottom wall, wherein the bottom wall has an inner annular side and an outer annular side, a lower end of the peripheral wall is connected to the outer annular side of the bottom wall, a level of the outer annular side is higher than a level of the inner annular side, and the accommodating cavity is formed between the cup body and the liquid outlet pipeline; and a cup base having an upper end connected to the inner annular side of the bottom wall, and disposed around the liquid outlet pipeline.

The present disclosure has the following characteristics and advantages:

1. In the downhole oil, gas, water and sand separation method of the present disclosure, a plurality of accommodating cavities are designed in the flow direction of the produced liquid in the liquid outlet pipeline, so that the crude oil in the oil jacket annulus flows into the liquid outlet pipeline simultaneously through one of the liquid inlet hole groups corresponding to each of the accommodating cavities; and by using the plurality of accommodating cavities longitudinally distributed on the liquid outlet pipeline to share the flow rate of the crude oil in the oil jacket annulus in the whole wellbore, the descending velocity of the crude oil in each of the accommodating cavities can be decreased to 1/N (N is the number of accommodating cavities) of the descending velocity of the crude oil at the liquid inlet in the oil jacket annulus of the conventional oil well, i.e. the relative floating velocity of the oil drops or bubbles in the crude oil is increased, thus finally achieving the purpose of an efficient separation of oil, gas and water.

In addition, the downhole oil, gas, water and sand separation method of the present disclosure can enable the sand in the high water-content crude oil to be discharged from the accommodating cavity through a plurality of sand outlet holes of the accommodating cavity, thus realizing the separation between sand and water.

Furthermore, the downhole oil, gas, water and sand separation method of the present disclosure can improve the separation velocity of the oil drops in the crude oil by providing a filter material box containing a porous medium in the accommodating cavity.

2. In the downhole oil, gas, water and sand separator of the present disclosure, a plurality of settling cups are provided in an axial direction of the liquid outlet pipeline, each corresponding to one of the liquid inlet hole groups on the liquid outlet pipeline; the total amount of the crude oil in the whole oil jacket annulus is shared by the plurality of settling cups, so that the crude oil in the oil jacket annulus is divided into a plurality of parts, thus achieving the purposes of decreasing the descending velocity of the liquid in each of the settling cups and promoting the separation of the oil drops or bubbles from the water.

DETAILED DESCRIPTION OF THE PREFERRED EMBODIMENTS

The technical solutions in the embodiments of the present disclosure will be described clearly and completely as below with reference to the drawings in the embodiments of the present disclosure. Obviously, those as described are only parts, rather than all, of the embodiments of the present disclosure. Based on the embodiments of the present disclosure, any other embodiment obtained by a person skilled in the art without paying any creative labor shall fall within the protection scope of the present disclosure.

Embodiment 1

Figure 1:
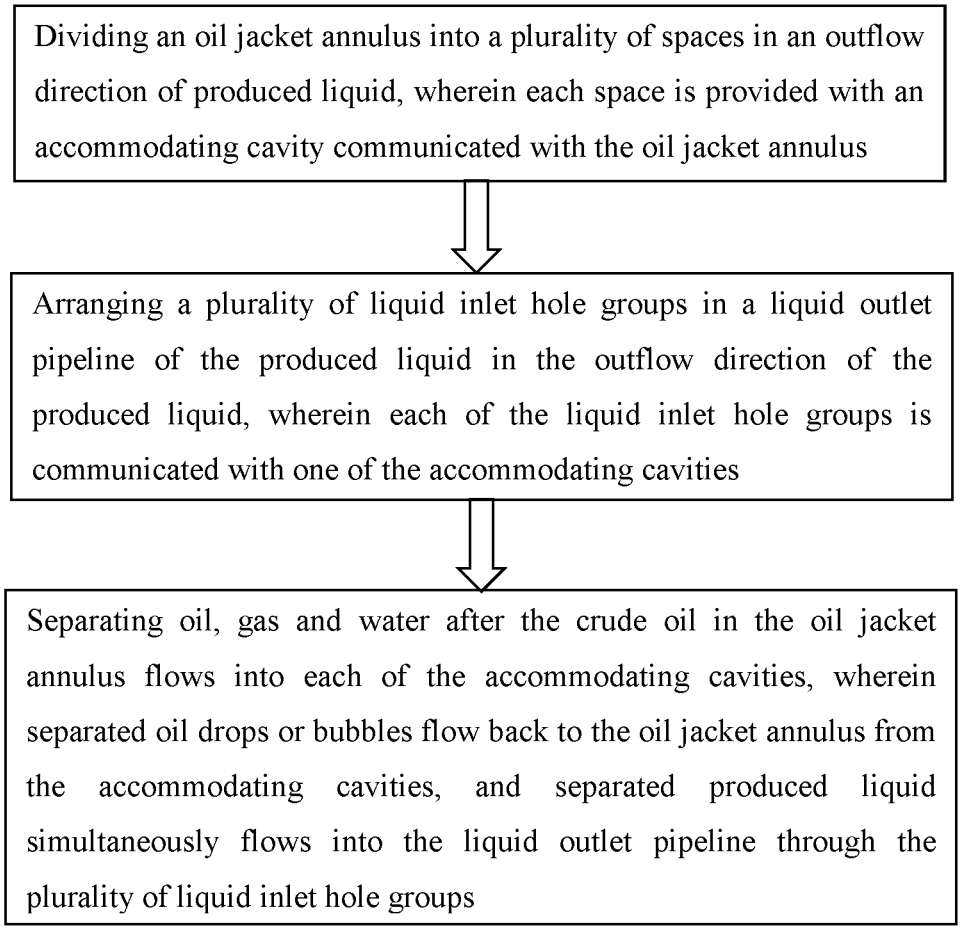
FIG. 1 is a flowchart of a downhole oil, gas, water and sand separation method of the present disclosure.

As illustrated in FIG. 1, the present disclosure provides a downhole oil, gas, water and sand separation method, comprising:

step 1: dividing an oil jacket annulus into a plurality of spaces in an outflow direction of produced liquid, wherein each of the spaces is provided with an accommodating cavity communicated with the oil jacket annulus, so that crude oil in the oil jacket annulus is divided into a plurality of parts which flow into a plurality of accommodating cavities, respectively, a descending velocity of liquid in crude oil in each of the accommodating cavities is decreased relative to a descending velocity of liquid in the crude oil in the oil jacket annulus, and an ascending velocity of oil drops or bubbles in the crude oil in each of the accommodating cavities is increased relative to an ascending velocity of oil drops or bubbles in the crude oil in the oil jacket annulus;

step 2: arranging a plurality of liquid inlet hole groups in a liquid outlet pipeline of the produced liquid in the outflow direction of the produced liquid, wherein each of the liquid inlet hole groups is communicated with one of the accommodating cavities;

step 3: separating oil, gas and water after the crude oil in the oil jacket annulus flows into each of the accommodating cavities, wherein separated oil drops or bubbles flow back to the oil jacket annulus from the accommodating cavities, and separated produced liquid simultaneously flows into the liquid outlet pipeline through the plurality of liquid inlet hole groups.

Specifically, only if a floating velocity of the oil drops or bubbles is larger than a downward flow velocity of the produced liquid in the oil jacket annulus, the oil drops or bubbles will be separated from the produced liquid. According to the theories of the physical chemistry and the hydromechanics, the floating velocity $v_{É\dagger}$ of the oil drops or bubbles can be calculated according to the Stokes formula, i.e.

$$v_{É\uparrow} = KD^2\frac{\Delta\rho}{\mu} \tag{1}$$

In formula (1): K is a constant; D is a diameter of an oil drop or bubble, with a unit of m; $\Delta\rho$ is a density difference between the oil drops or bubbles and the produced liquid, with a unit of $kg/m^3$; and $\mu$ is a viscosity of the produced liquid, with a unit of Pa·s. For a well, the above parameters are all constants, and the calculation result shows that the ascending velocity of bubbles or oil drops is very small.

The descending velocity of the crude oil at the liquid inlet in the oil jacket annulus of the conventional oil well is:

$$v_{\downarrow} = \frac{Q}{86400A} \tag{2}$$

In formula (2): Q is a liquid production capacity of the oil well, with a unit of $m^3/d$; and A is a cross-sectional area of the oil jacket annulus, with a unit of $m^2$.

It can be seen that in the conventional production process, the liquid production capacity Q of the oil well is determined according to the parameters in a specific oil reservoir, such as a viscosity, a permeability and an oil layer thickness of the crude oil. The liquid production capacity Q of the oil well and the cross-sectional area A of the oil jacket annulus cannot be changed at will, that is to say, for a specific oil well, the descending velocity of the crude oil in the oil jacket annulus is a constant.

In steps 1 and 2 of the present disclosure, a plurality of spaces are divided in an oil jacket annulus in an outflow direction of produced liquid, and an accommodation cavity communicated with the oil jacket annulus is provided in each of the spaces; then, a plurality of liquid inlet hole groups are arranged in a liquid outlet pipeline of the produced liquid in the outflow direction of the produced liquid, each of the liquid inlet hole groups being communicated with one of the accommodating cavities. According to the present disclosure, the plurality of accommodating cavities are designed in the flow direction of the produced liquid in the liquid outlet pipeline, so that the crude oil in the oil jacket annulus flows into the liquid outlet pipeline through one of the liquid inlet hole groups that is corresponding to each of the accommodating cavities, respectively; thus, at this time, the descending velocity of the crude oil in the accommodating cavities is changed into:

$$v'_{\downarrow} == \frac{1}{N}\frac{Q}{86400A} = \frac{1}{N}v_{\downarrow} \quad (3)$$

In formula (3): N is the number of the accommodating cavities. It is obvious that by using the plurality of accommodating cavities longitudinally distributed on the liquid outlet pipeline to share the flow rate of the crude oil in the oil jacket annulus in the whole wellbore, the descending velocity of the crude oil in each of the accommodating cavities can be decreased to 1/N of the descending velocity of the crude oil at the liquid inlet in the oil jacket annulus of the conventional oil well, i.e. the relative floating velocity of the oil drops or bubbles in the crude oil is increased, thus finally achieving the purpose of an efficient separation of oil, gas and water.

In one embodiment of the present disclosure, in order to provide sufficient residence time of the crude oil in the accommodating cavities to ensure the separation effect, the number N of the accommodating cavities required by all of the liquid inlet hole groups in the liquid outlet pipeline is calculated according to the following formula:

$$N = \frac{QT_t}{86400V} \quad (4)$$

In formula (4): Q is a liquid production capacity of the oil well; $T_t$ is expected residence time of the crude oil in the accommodating cavity; and V is a volume of the accommodating cavity.

On the basis of formula (4), a total length L of the separator composed of the plurality of accommodating cavities can be calculated as follows:

$$L = N \vee L = \frac{QT_t \vee L}{86400V} \quad (5)$$

In formula (5): ΔL is an arrangement interval of the accommodation cavities, with a unit of m. The formula shows that the length L of the separator mainly depends on the liquid production capacity Q of the oil well, the expected residence time $T_t$ of the crude oil in the accommodating cavity, the volume V of the accommodating cavity and the arrangement interval ΔL of the accommodating cavity.

Specifically, for an oil well, the above factors are variable in the design process. First, the total length L depends on the expected residence time $T_t$ of the crude oil in the accommodating cavity, which is generally 25 s to 150 s and mainly influenced by a shape of the accommodating cavity and a material for making the accommodating cavity; second, the total length L depends on the arrangement interval ΔL of the accommodating cavities, which actually is an interval between every adjacent two of the liquid inlet hole groups in the liquid outlet pipeline and generally 10 mm to 55 mm; the experimental results show that the separation efficiency increases with the decrease of the arrangement interval ΔL of the accommodating cavities, and vice versa; finally, the total length L depends on the volume V of the accommodating cavity, which is influenced by a size of the oil jacket annulus; as the size of the oil well casing increases and the size of the liquid outlet pipeline decreases, the designable volume of the accommodating cavity increases, and vice versa; generally, the volume V of the accommodating cavity is 50 ml to 250 ml. It can be seen that the liquid production capacity Q of the oil well is the decisive factor for the total length L of the separator.

In the embodiment of the present disclosure, in step 2, each of the liquid inlet hole groups comprises a plurality of liquid inlet holes spaced apart in a circumferential direction of the liquid outlet pipeline, and a diameter d of the liquid inlet hole is calculated according to the following formula:

$$d = \sqrt[4]{\frac{20\rho q^2}{\Delta p \pi^2}} \quad (6)$$

In formula (6): q is a flow rate of the produced liquid flowing through the liquid inlet hole; ρ is a density of the produced liquid; and Δp is a pressure difference between an interior and an exterior of the liquid outlet pipeline.

wherein the pressure difference Δp between the interior and the exterior of the liquid outlet pipeline is calculated according to the following formula (7):

$$\Delta p = 1.25\rho v^2 \quad (7)$$

In formula (7): v is a flow velocity of the produced liquid passing through the liquid inlet hole.

In addition, the flow rate q of the produced liquid flowing through the liquid inlet hole is calculated according to the following formula (8):

$$q = \frac{Q}{Nn} \quad (8)$$

wherein Q is a liquid production capacity of the oil well; N is the number of the accommodating cavities; and n is the number of the liquid inlet holes in each of the liquid inlet hole groups.

It is obvious from formula (6) that there is a corresponding relationship between the diameter d of the liquid inlet hole and the working pressure difference Δp. If the diameter d of the liquid inlet hole increases, it is more favorable for machining, and the working pressure difference Δp decreases, so that the working condition of the oil well pump is less influenced. On the other hand, if the diameter d of the liquid inlet hole decreases, it is less favorable for machining, and the working pressure difference Δp increases, so that the working condition of the oil well pump is more influenced by the addition of the gas anchor, and a clogging can be easily caused by the impurities in the produced liquid at the same time.

At this point, it seems that a conclusion can be drawn as follows: no matter from the perspective of machining or from the perspective of reducing the influence of the addition of the gas anchor on the working condition of oil well pump, it seems to be concluded that a larger diameter d of the liquid inlet hole is better. However, everything has two sides, and if the diameter of the liquid inlet hole is too large, the following problems will be caused.

When the produced liquid flows in the liquid outlet pipeline, a certain friction pressure difference will occur due to the viscosity. Through the theoretical analysis and derivation, the calculation formula of the friction pressure difference $\Delta p_f$ in the whole liquid outlet pipeline can be obtained as follows:

$$\Delta p_f = \int_0^L dp_f = 41.5 \int_0^L \frac{Q(x)\mu}{D^4} dx \tag{9}$$

In formula (9): D is an inner diameter of the liquid outlet pipeline, with a unit of m; Q(x) is a flow rate at a different position x of the liquid outlet pipeline, with a unit of $m^3/s$; μ is a viscosity of the produced liquid, with a unit of Pa·s. This friction pressure difference will lead to a certain difference between the working pressure differences at the upper and lower ends of the liquid outlet pipeline. According to the calculation formula of the submerged discharge flow rate of the small orifice, in the flow direction of the produced liquid, the flow rates at the liquid inlet holes at an upstream end (i.e. in the vertical wellbore, the upstream end is a lowermost end of the liquid outlet pipeline) and a downstream end (i.e. in the vertical wellbore, the downstream end is an uppermost end of the liquid outlet pipeline) of the liquid outlet pipeline are:

$$q_n = KA\sqrt{2\frac{\Delta p}{\rho}} \tag{10}$$

$$q_1 = KA\sqrt{2\frac{\Delta p + \Delta p_f}{\rho}} \tag{11}$$

Now, a flow ratio is defined as $$\alpha = \frac{q_1}{q_n} \tag{12}$$

then $$\alpha = \sqrt{\frac{\Delta p + \Delta p_f}{\Delta p}} \tag{13}$$

As can be seen from the above formula, if the same diameter of the liquid inlet hole is adopted in the liquid outlet pipeline in the flow direction of the produced liquid, the flow ratio α is always larger than 1.0. That is to say, due to the existence of the friction pressure difference $\Delta p_f$, the flow pressure difference at the orifice at the downstream end of the liquid outlet pipeline is larger than the flow pressure difference at the orifice at the upstream end of the liquid outlet pipeline by $\Delta p_f$, which causes the flow rate through the liquid inlet hole group at the downstream end of the liquid outlet pipeline to be larger than the flow rate through the liquid inlet hole group at the upstream end of the liquid outlet pipeline. Thus, if a larger diameter of the liquid inlet hole is adopted, the working pressure difference Δp of corresponding gas anchor becomes smaller; although the larger diameter is favorable for the machining of the liquid inlet hole, the flow rate ratio α will be too large; in serious cases, the flow rate at the orifice at the downstream end of the liquid outlet pipeline may be much larger than the flow rate at the orifice at the upstream end of the liquid outlet pipeline, and almost all of the produced liquid flows smoothly into the liquid outlet pipeline from the liquid inlet hole group at the downstream end thereof while carrying gas into the anchor pipe, thus causing the gas anchor to be meaningless.

In order to solve the problems of uneven liquid inletting and large flow rate at the upstream and downstream ends of the liquid outlet pipeline, the working pressure difference Δp between the interior and the exterior of the liquid outlet pipeline can be increased by decreasing the diameter of the liquid inlet hole, thus eliminating the influence of uneven liquid inletting caused by the friction pressure difference $\Delta p_f$ inside the liquid outlet pipeline as much as possible.

Since the diameter of the liquid inlet hole, the working pressure difference and the flow ratio are unknown before the design and they are closely related, determining a reasonable upper limit of the flow ratio becomes the difficulty and innovation point in the design and calculation of the separation method. It is unrealistic in the design to blindly pursue an infinite approach of the flow rate ratio to 1.0. Thus, the upper limit of the flow ratio used in the actual design process is 1.05. When the relative difference between the flow rates at the liquid inlet hole groups at the upstream and downstream ends of the liquid outlet pipeline is less than 5%, it can be deemed that the equal flow rate has been achieved.

Figure 2:
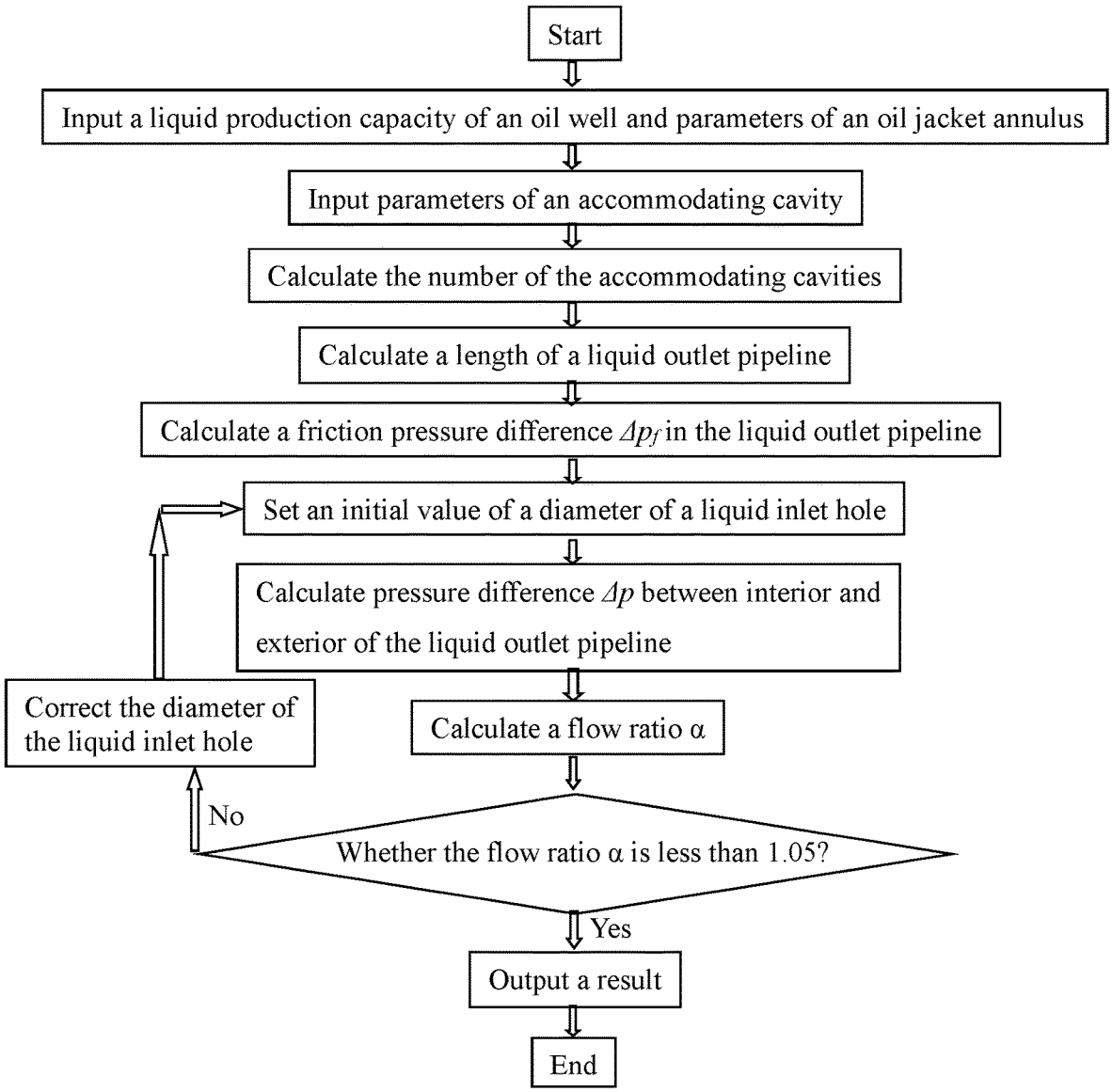
FIG. 2 is a schematic diagram of specific steps of a downhole oil, gas, water and sand separation method of the present disclosure.

In the actual calculation, as illustrated in FIG. 2, first, an initial value (usually 1 mm) of the diameter of the liquid inlet hole in the liquid inlet hole group is given, then the working pressure difference Δp between the interior and the exterior of the liquid inlet hole and the friction pressure difference $\Delta p_f$ inside the liquid outlet pipeline are calculated; next, the corresponding flow ratio is calculated according to formula (12). If the corresponding flow ratio is larger than 1.05, the diameter of the liquid inlet hole is gradually decreased until the requirement of the flow ratio is satisfied, whereas if the corresponding flow ratio is less than 1.05, the diameter of the liquid inlet hole is gradually increased until the requirement of the flow ratio is satisfied, so that the designed diameter of the liquid inlet hole is not only beneficial to the machining process of the liquid inlet hole, but also can meet the design object of the equal flow rate.

The calculation result according to the flowchart of FIG. 2 shows that under the condition that the liquid production capacity Q of the oil well is 50 $m^3/d$ to 200 $m^3/d$ (the required length of the separator is 8 m to 23 m), the design object of a flow ratio less than 1.05 can be achieved by using a liquid inlet hole with a diameter of 0.8 mm to 1.0 mm.

In the design and calculation process of the separation method adopting the uniform diameter of the liquid inlet hole from the downstream end to the upstream end of the liquid outlet pipeline, it is also possible that the separator is too long (for example, more than 30 m) and the diameter of the liquid inlet hole is too small (for example, less than 0.8 mm) for the oil well with too large a liquid production capacity (for example, more than 200 $m^3/d$), which is not conducive to machining and is prone to clogging of the liquid inlet hole. At this time, the liquid inlet flow rate at the downstream end of the liquid outlet pipeline may be decreased by gradually increasing the diameter of the liquid inlet hole from the downstream end to the upstream end of the liquid outlet pipeline or increasing the number of the liquid inlet holes corresponding to each of the accommodating cavities, so as to increase the liquid inlet flow rate at the upstream end of the liquid outlet pipeline, thereby keeping the flow rate in the longitudinal direction of the separator substantially equal.

Therefore, in one embodiment of the present disclosure, step 3 comprises: determining pressure differences in the oil jacket annulus and the liquid outlet pipeline according to liquid production capacities of different oil wells, areas of different oil jacket annuluses, and an area of the liquid outlet pipeline; adjusting open areas of the liquid inlet hole groups at different positions in the liquid outlet pipeline according to the pressure differences, so that flow rates of the produced liquid simultaneously flowing into the liquid outlet pipeline from the liquid inlet hole groups are equal (i.e. the flow rates of the produced liquid flowing into the liquid outlet pipeline simultaneously through the respective liquid inlet hole groups are approximately equal); by utilizing the principle of equal flow of a plurality of accommodating cavities, i.e. a plurality of accommodating cavities or other devices with similar structures in the axial direction of the liquid outlet pipeline, decreasing the descending velocity of the liquid in the crude oil in each of the accommodating cavities relative to the descending velocity of the liquid in the crude oil in the oil jacket annulus, thereby promoting the separation of the oil droplets or bubbles from the water in the crude oil. The advantage of this arrangement can overcome the influence of the change in the pressure difference between the interior and the exterior caused by the flow resistance difference on the flow rate changes in different parts of the liquid outlet pipeline during the flow of the produced liquid in the liquid outlet pipeline and the oil jacket annulus, and is favorable for a rapid separation of the oil drops or bubbles.

In one embodiment of the present disclosure, the downhole oil, gas, water and sand separation method further comprises:

step 4: placing a filter material in each of the accommodating cavities, so that the oil drops in the crude oil become oil films when flowing through the filter material, wherein an upward pressure gradient that the oil films undergo in the filter material is larger than a downward pressure gradient that the oil films undergo, thereby promoting the oil films to slide upward in the filter material and form large oil drops.

Specifically, the accommodating cavity is provided therein with a filter material box, which is disposed around the liquid outlet pipeline, located at a downstream end of one of the liquid inlet hole groups correspondingly communicated with each of the accommodating cavities in the outflow direction of the produced liquid, and provided therein with the filter material.

The filter material in the filter material box is a porous medium capable of changing wettability, such as oleophilic quartz sand or coated quartz sand, etc. The upper surface and the lower surface of the filter material box are both of a screen structure with a screen size smaller than a particle diameter of the filter material.

The filter material box adopts the principle of phase infiltration, so that when the oil drops in the high water-content crude oil flow through the filter material, the small oil drops become oil films; as the upward pressure gradient of the oil films is larger than the downward pressure gradient, the oil films slide upward in the filter material; since the oil films are adsorbed on the pore surfaces in the porous medium which has a pressure gradient from bottom to top, the oil films float out of the filter material under the influence of the pressure gradient, and the remaining liquid directly sinks to the bottom of the accommodating cavity through the porous medium; and the oil films form large oil drops at the outlet of the porous medium, so that the floating velocity is faster, and the separation efficiency is improved.

In the embodiment of the present disclosure, the accommodating cavity is provided with a plurality of sand outlet holes communicated with the oil jacket annulus. Those sand outlet holes enable sand in the high water-content crude oil to be discharged from the accommodating cavity, thereby realizing the separation of sand and water.

Embodiment 2

As illustrated in FIGS. 3 to 7, the present disclosure further provides a downhole oil, gas, water and sand separator 10, which is designed using the downhole oil, gas, water and sand separation method of Embodiment 1. Of course, separators of other structures can also be designed according to the downhole oil, gas, water and sand separation method of Embodiment 1. The separator 10 of Embodiment 2 is only one specific example, and any other separator of the similar structure designed by a person skilled in the art according to the example of Embodiment 2 shall fall within the scope of the embodiments of the present disclosure.

The downhole oil, gas, water and sand separator 10 comprises a liquid outlet pipeline 1 and a plurality of settling cups 2, wherein the liquid outlet pipeline 1 is provided therein with a plurality of liquid inlet hole groups 11 spaced apart in an axial direction thereof; and the plurality of settling cups 2 are connected to each other to be disposed around the liquid outlet pipeline 1, each having an accommodating cavity 21 communicated with each of the liquid inlet hole groups 11, and having a liquid inlet 24.

Figure 3:
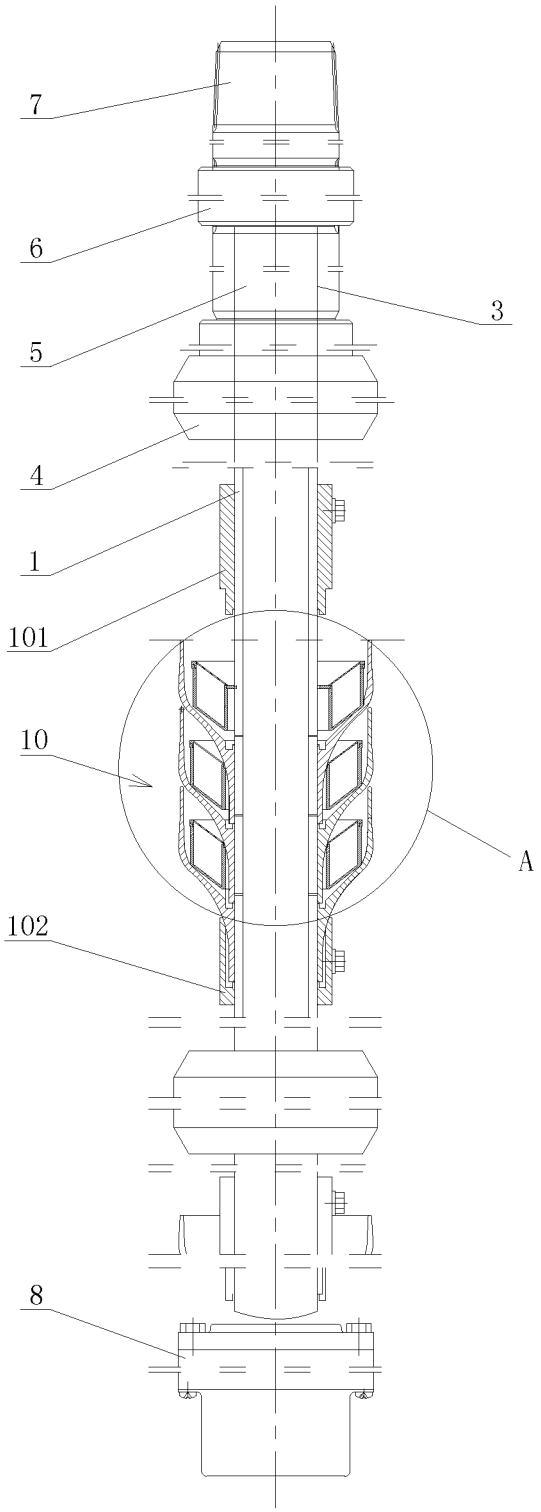
FIG. 3 is a schematic structural view of a downhole oil, gas, water and sand separator of the present disclosure mounted on a downhole oil pipe.

Specifically, the plurality of settling cups 2 are connected to each other to be disposed around the liquid outlet pipeline 1, an upper end of the plurality of settling cups 2 is fixedly connected to the liquid outlet pipeline 1 by an upper locating sleeve 101, and a lower end of the plurality of settling cups 2 are fixedly connected to the liquid outlet pipeline 1 by a lower locating sleeve 102. The downhole oil, gas, water and sand separator 10 of the present disclosure is disposed within a downhole casing; as illustrated in FIG. 3, the liquid outlet pipeline 1 of the downhole oil, gas, water and sand separator 10 is connected to an oil pipe 3 disposed within the casing; an oil jacket annulus 31 formed between the casing and the oil pipe 3 is communicated with the accommodating cavity 21 of each of the settling cups 2 through the liquid inlet 24 of that settling cup 2. In an exemplary embodiment, the lower end of the oil pipe 3 may be sequentially connected to a plurality of downhole oil, gas, water and sand separators 10 spaced apart, wherein the upper end of the oil pipe 3 is connected to an oil well pump (not illustrated) through a separator joint 4, a pipe string joint 5, a coupling 6 and an oil well pump joint 7 sequentially, and the lower ends of the plurality of downhole oil, gas, water and sand separators 10 are connected to a plug or a well flushing valve 8. An outer diameter of the downhole oil, gas, water and sand separator 10 is smaller than an outer diameter of the separator joint 4.

According to the present disclosure, a plurality of settling cups 2 are provided in an axial direction of the liquid outlet pipeline 1, each corresponding to one of the liquid inlet hole groups 11 in the liquid outlet pipeline 1, to share a total amount of the crude oil in the whole oil jacket annulus 31, so that the crude oil in the oil jacket annulus 31 is divided into a plurality of parts, thereby achieving the purposes of decreasing the descending velocity of the liquid in each of the settling cups 2 and promoting the separation of the oil drops or bubbles from the water.

For example, when the downhole oil, gas, water and sand separator 10 has n settling cups 2 (n is a natural number), the descending velocity of the liquid in each of the settling cups 2 is 1/n of the descending velocity of all of the crude oil in the oil jacket annulus 31. In one embodiment, when the number of the settling cups 2 is selected to be 30 to 2,000, the total amount of the crude oil in the whole oil jacket annulus 31 is shared by those numerous settling cups 2, so that the descending velocity of the liquid in each of the settling cups 2 is decreased by 30 to 2,000 times compared with the descending velocity of the liquid in an ordinary separator, thereby improving the separation efficiency of the oil drops or bubbles from the water.

Figure 4:
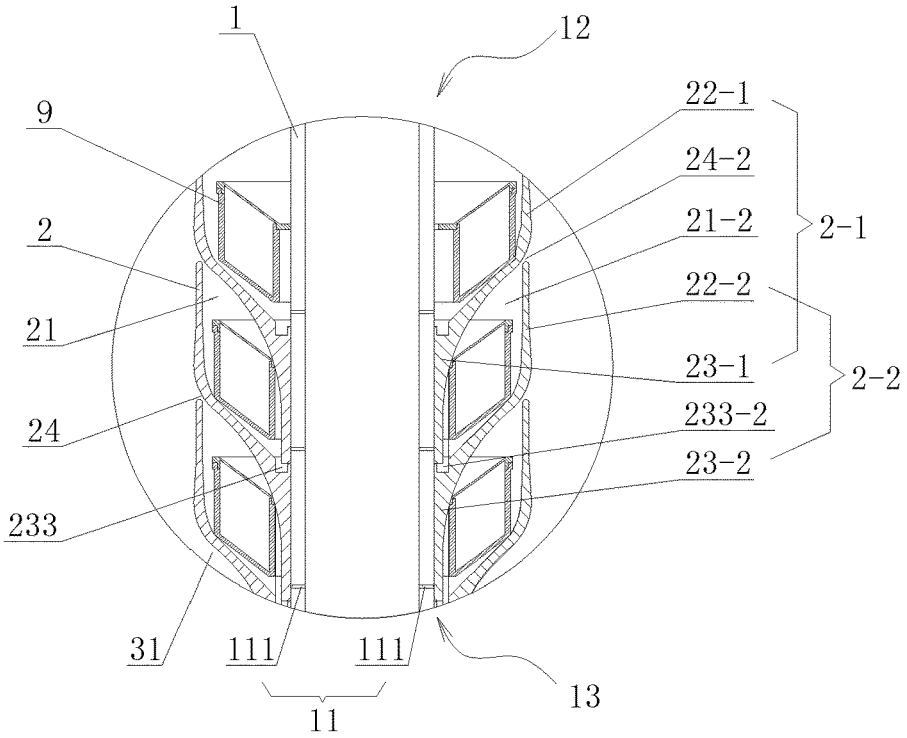
FIG. 4 is an enlarged view of Part A in FIG. 3.

In one embodiment of the present disclosure, as illustrated in FIG. 4, each of the liquid inlet hole groups 11 comprises a plurality of liquid inlet holes 111 spaced apart in a circumferential direction of the liquid outlet pipeline 1; and a diameter of the liquid inlet holes 111 located at a liquid outlet end 12 of the liquid outlet pipeline 1 is larger than a diameter of the liquid inlet holes 111 located at a tail end 13 of the liquid outlet pipeline 1.

Specifically, the liquid outlet pipeline 1 is provided with a plurality of liquid inlet hole groups 11 spaced apart in an axial direction, each group having a plurality of liquid inlet holes 111 spaced apart in a circumferential direction of the liquid outlet pipeline 1. In this embodiment, each of the liquid inlet hole groups 11 comprises 2 to 12 liquid inlet holes 111 having a diameter of 0.5 mm to 2.0 mm.

According to the downhole oil, gas, water and sand separation method of Embodiment 1, the diameter of the liquid inlet holes 111 located at the liquid outlet end 12 of the liquid outlet pipeline 1 is designed to be larger than the diameter of the liquid inlet holes 111 located at the tail end 13 of the liquid outlet pipeline 1, so that the flow rates of the produced liquid flowing into the liquid outlet pipeline 1 through the respective liquid inlet hole groups 11 are equal. Thus, by adopting the multi-cup equal flow principle, i.e. by utilizing the plurality of settling cups 2 or other devices with similar structures in the axial direction of the liquid outlet pipeline 1, the descending velocity of the liquid in each of the settling cups 2 is decreased to promote the separation of oil droplets or bubbles from the water. Meanwhile, the advantage of this arrangement can overcome the influence of the change in the pressure difference between the interior and the exterior caused by the flow resistance difference on the flow rate changes in different parts of the liquid outlet pipeline 1 during the flow of the produced liquid in the liquid outlet pipeline 1 and the oil jacket annulus 31, thereby keeping the flow rates in the longitudinal direction of the downhole oil, gas, water and sand separator 10 substantially equal, and facilitating the rapid separation of the oil drops or bubbles.

In one embodiment of the present disclosure, the settling cup 2 is provided therein with a filter material box 9, which is disposed around the liquid outlet pipeline 1, located at a downstream end of one of the liquid inlet hole groups 11 correspondingly communicated with each of the accommodating cavities 21 in the outflow direction of the produced liquid, and provided therein with a filter material.

Figure 6:
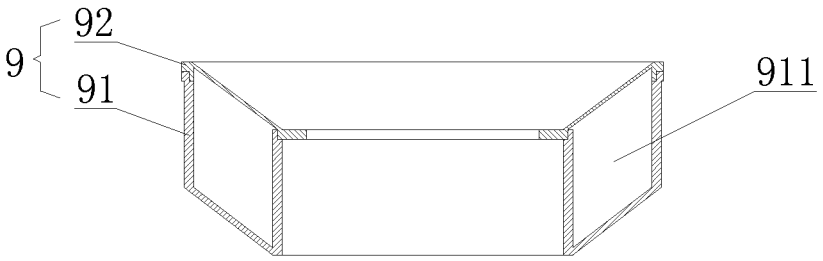
FIG. 6 is a front cross-sectional view of a filter material box of a downhole oil, gas, water and sand separator of the present disclosure.
Figure 7:
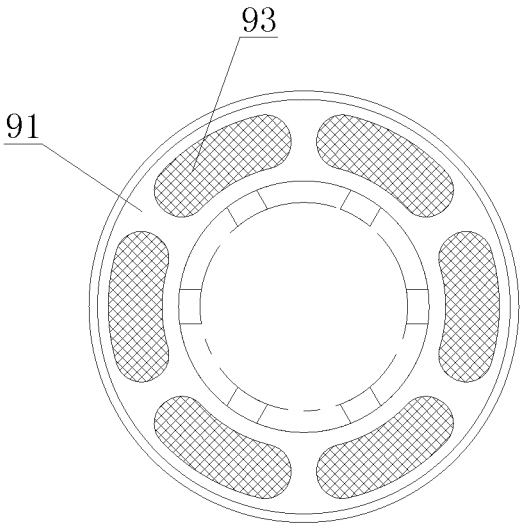
FIG. 7 is a bottom view of a filter material box of a downhole oil, gas, water and sand separator of the present disclosure.

Specifically, the filter material box 9 is substantially in a shape of a flat circular cylinder, and as illustrated in FIG. 6, the filter material box 9 is composed of a base disk 91 and a cover 92 fastened to the base disk 91; the base disk 91 is substantially in a shape of an annular barrel and provided with a filter material tank 911 for containing a filter material; the cover 92 is substantially in a shape of a funneled annular plate, and fastened to the filter material tank 911 of the base disk 91 to prevent the filter material from falling out of the base disk 91; as illustrated in FIG. 7, a bottom wall of the base disk 91 and the cover 92 are both provided with sieve pores 93 for the oil drops to flow into or out of the filter material tank 9. In this embodiment, the filter material in the filter material box 9 is a porous medium capable of changing wettability, such as oleophilic quartz sand or coated quartz sand, etc. and the diameter of the sieve pore is smaller than the particle diameters of the filter material.

The filter material box 9 adopts the principle of phase infiltration, so that when the oil drops in the high water-content crude oil flow through the filter material, the small oil drops become oil films; since the upward pressure gradient that the oil films undergo is larger than the downward pressure gradient that the oil films undergo, the oil films slide upward in the filter material; since the oil films are adsorbed on the pore surfaces in the porous medium which has a pressure gradient from bottom to top, the oil films float out of the filter material under the influence of the pressure gradient, and the remaining liquid directly sinks to the bottom of the accommodating cavity 21 of the settling cup 2 through the porous medium; and the oil films form large oil drops at the outlet of the porous medium, so that the floating velocity is faster, and the separation efficiency is improved.

The downhole oil, gas, water and sand separator 10 of the present disclosure adopts a structure in which a plurality of settling cups 2 are vertically connected to one another, and a filter material box 9 is provided in each of the settling cups 2. Compared with the traditional separator, the downhole oil, gas and sand separator 10 of the present disclosure realizes the efficient separation of the oil drops or bubbles from the water, and can be employed in the single well integral injection and production technique for the high water-content well and to improve the downhole pump efficiency of the oil well.

Figure 5:
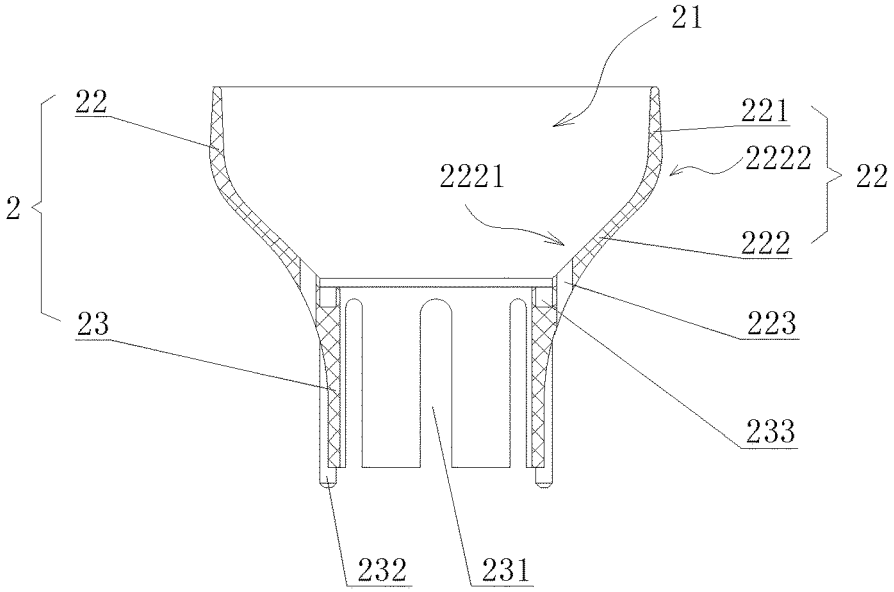
FIG. 5 is a schematic cross-sectional structural view of a settling cup of a downhole oil, gas, water and sand separator of the present disclosure.

In one embodiment of the present disclosure, as illustrated in FIG. 5, the settling cup 2 comprises a cup body 22 and a cup base 23, wherein the cup body 22 has a peripheral wall 221 and a bottom wall 222, the bottom wall 222 has an inner annular side 2221 and an outer annular side 2222, a lower end of the peripheral wall 221 is connected to the outer annular side 2222 of the bottom wall 222, a level of the outer annular side 2222 is higher than a level of the inner annular side 2221, and the accommodating cavity 21 is formed between the cup body 22 and the liquid outlet pipeline 1; an upper end of the cup base 23 is connected to the inner annular side 2221 of the bottom wall 222, and the cup base 23 is disposed around the liquid outlet pipeline 1.

Specifically, the cup body 22 is substantially in a cylindrical shape with a peripheral wall 221 and a bottom wall 222, wherein a lower end of the peripheral wall 221 is connected to the outer annular side 2222 of the bottom wall 222; the bottom wall 222 is substantially in a circular shape, and as can be seen from the front view of the settling cup 2 illustrated in FIG. 5, the level of the outer annular side 2222 of the bottom wall 222 is higher than the level of the inner annular side 2221 of the bottom wall 222.

The cup base 23 is substantially in a cylindrical shape, with an upper end connected to the inner annular side 2221 of the bottom wall 222 of the cup body 22. In this embodiment, a lower end of the cup base 23 is provided with a plurality of opening grooves 231 spaced apart in a circumferential direction to correspond to the liquid inlet hole groups 11 in the liquid outlet pipeline 1. Further, the lower end of the cup base 23 may be provided with a plurality of positioning pins 232 protruding therefrom, the upper end of the cup base 23 is provided with a plurality of positioning holes 233, the positioning pins 232 and the positioning holes 233 are oppositely and vertically disposed, and every adjacent two of the settling cups 2 are connected to each other by inserting the positioning pins 232 of one of the settling cups 2 into the positioning holes 233 of the other of the settling cups 2. In the present disclosure, the lower end of the cup base 23 is provided with two positioning pins 232 opposite to each other in the radial direction; the upper end of the cup base 23 is provided with two positioning holes 233 opposite to each other in the radial direction; and the positions of the two positioning pins 232 of the cup base 23 are vertically corresponding to the positions of the two positioning holes 233 thereof.

During usage, the plurality of settling cups 2 of the present disclosure are plugged vertically, and an example in which two settling cups are plugged vertically will be described herein.

Specifically, as indicated by the reference numerals in the right of FIG. 4, a cup base 23-1 of a settling cup 2-1 located above is inserted into an accommodating cavity 21-2 of a cup body 22-2 of a settling cup 2-2 located below; at this time, a positioning pin (not illustrated) of the cup base 23-1 of the settling cup 2-1 located above will be inserted into a positioning hole 233-2 of the cup base 23-2 of the settling cup 2-2 located below, thereby positioning and connecting the two settling cups plugged together. After the two settling cups are positioned by being plugged vertically, a gap portion is formed between an outer edge of an upper end of the cup body 22-2 of the settling cup 2-2 located below and the cup body 22-1 of the settling cup 2-1 located above, and the gap portion is an liquid inlet 24-2 of the settling cup 2-2 located below.

When being plugged vertically, the two settling cups are disposed around the liquid outlet pipeline 1 comprising the plurality of liquid inlet hole groups 11; at this time, the cup bases of the two settling cups just are disposed around and match the outer peripheral wall of the liquid outlet pipeline 1, and the liquid inlet hole group 11 in the liquid outlet pipeline 1 is disposed to be opposite and close to the accommodating cavity 21-2 of the cup body 22-2 of the settling cup 2-2 located below; at this time, after the cup base 23-1 of the settling cup 2-1 located above is inserted into the upper end of the cup base 23-2 of the settling cup 2-2 located below, the opening grooves of the cup base 23-2 are just opposite to the liquid inlet hole group 11 of the liquid outlet pipeline 1 to correspond to the position of the liquid inlet hole group 11. When an oil-water or gas-water separation is to be performed for the high water-content crude oil or other liquid requiring an oil-water or gas-water separation, the crude oil will flow into the accommodating cavity 21-2 of the cup body 22-2 of the settling cup 2-2 located below through the liquid inlet 24-2; after the liquid in the accommodating cavity 21-2 residues for a certain time, the oil drops or bubbles therein will be automatically separated from the water, thereby increasing the separation and ascending velocity of the oil drops or bubbles, and increasing the separation velocity of the oil drops or bubbles from the water.

In one embodiment of the present disclosure, the bottom wall 222 of the cup body 22 is provided with a plurality of sand outlet holes 223 communicated with the accommodating cavity 21 of the cup body 22. The sand outlet holes 223 allow sand in the liquid to be discharged from the bottom of the cup body 22 of the settling cup 2 to separate the sand from the water. In this embodiment, the sand outlet holes 223 are equally spaced apart in a circumferential direction of the bottom wall 222. Preferably, the sand outlet holes 223 are provided to be close to the inner annular side 2221 of the bottom wall 222, the number of the sand outlet holes 223 on the bottom wall 222 may be 4 to 12, and the sand outlet hole 223 may have a diameter which may be 1.0 mm to 4.0 mm.

In the embodiment of the present disclosure, a gap portion is formed between every adjacent two of the cup bodies 22, and the gap portion is the liquid inlet 24 of the settling cup.

Specifically, a width of the gap portion formed between the cup bodies 22 of the adjacent settling cups 2 is 0.5 mm to 2.5 mm, and the width of the gap portion can be determined by a length of the positioning pin 232 protruding from the lower end of the cup base 23 of each of the settling cups 2 and a depth of the positioning hole 233 recessed from the upper end of the cup base 23. The gap portion is designed to facilitate the separated oil drops or bubbles to escape therefrom on the one hand, and to facilitate the fluid in the oil jacket annulus to enter the settling cup 2 on the other hand.

Figure 8:
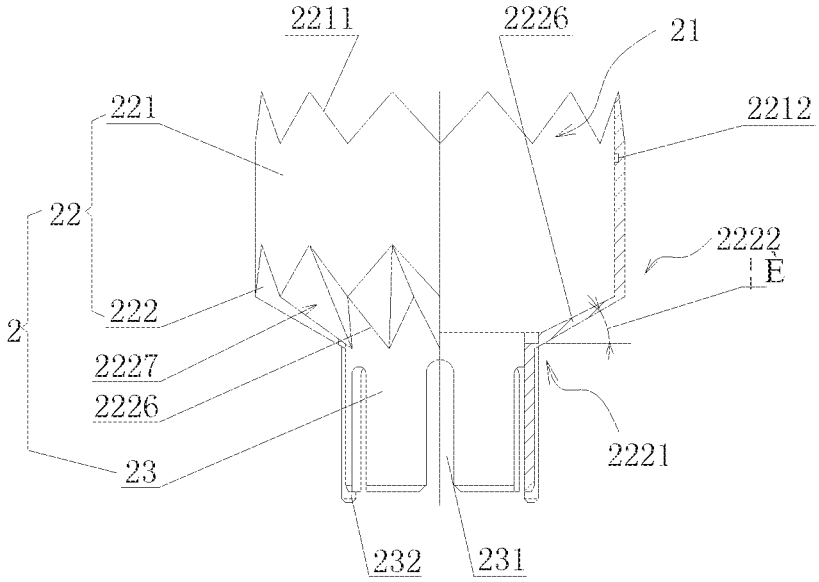
FIG. 8 is a schematic cross-sectional structural view of another embodiment of a settling cup of a downhole oil, gas, water and sand separator of the present disclosure.
Figure 13:
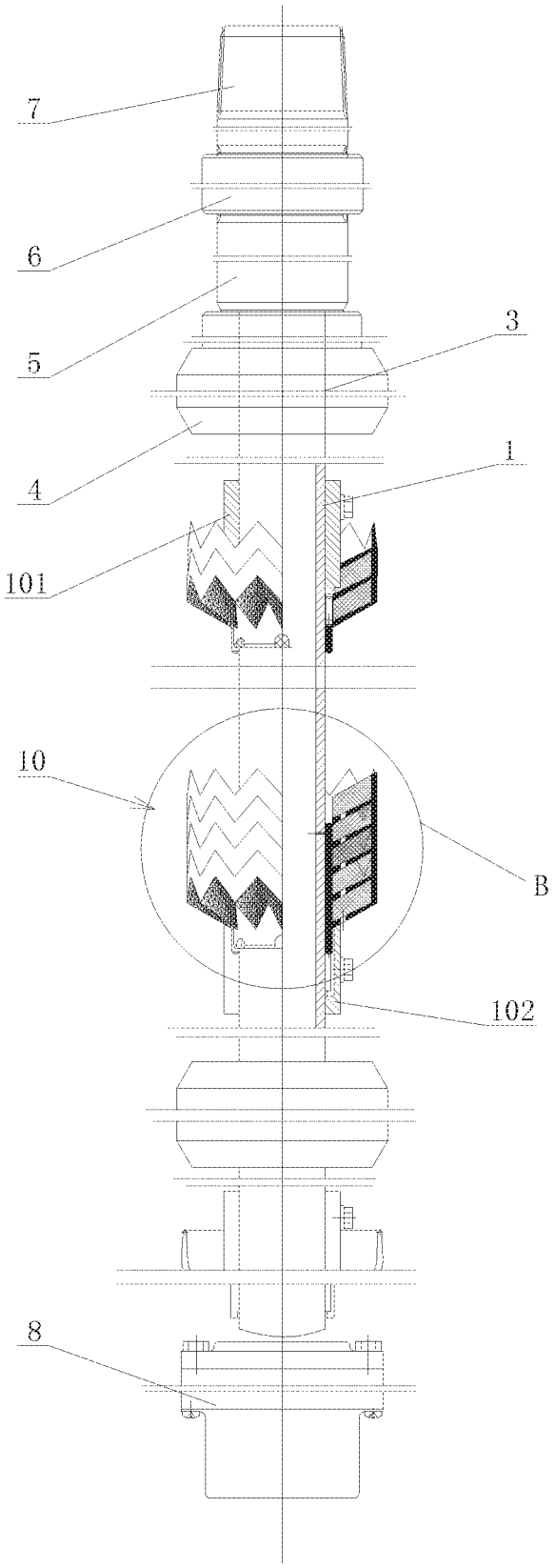
FIG. 13 is a schematic structural view of a downhole oil, gas, water and sand separator of another embodiment of the present disclosure mounted on a downhole oil pipe.
Figure 14:
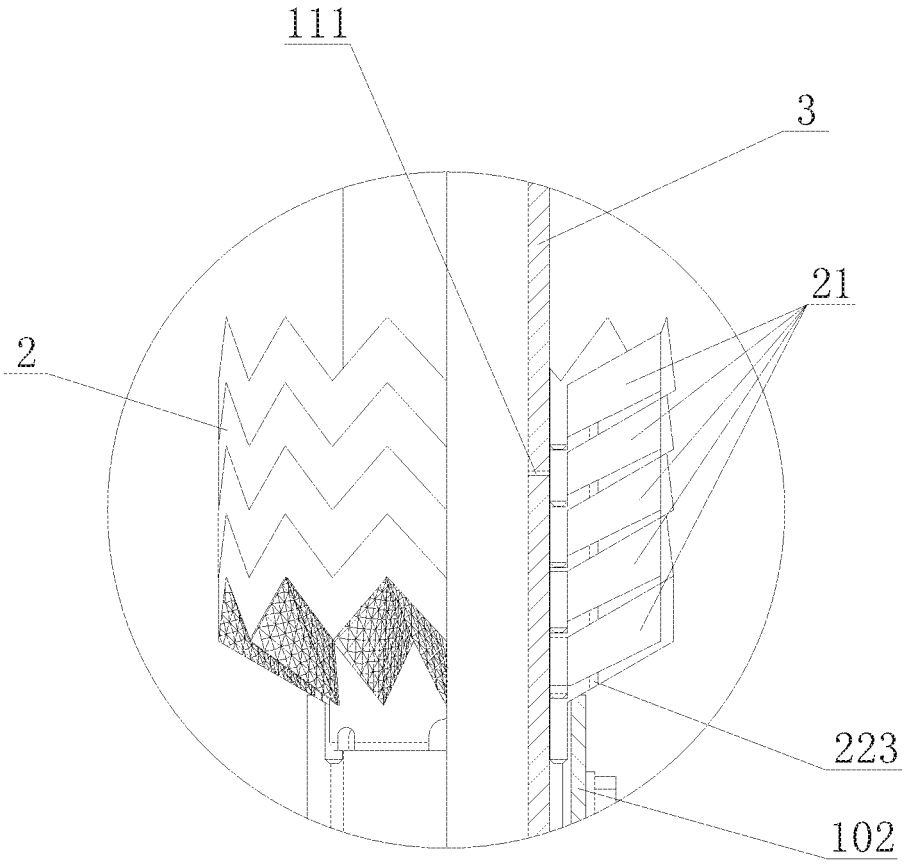
FIG. 14 is an enlarged view of Part B in FIG. 13.

In a feasible embodiment of the present disclosure, as illustrated in FIGS. 13, 14 and 8, the settling cup 2 comprises a cup body 22 and a cup base 23, wherein the cup body 22 has a peripheral wall 221 and a bottom wall 222, the bottom wall 222 has an inner annular side 2221 and an outer annular side 2222, a lower end of the peripheral wall 221 is connected to the outer annular side 2222 of the bottom wall 222, a level of the outer annular side 2222 is higher than a level of the inner annular side 2221, and the accommodating cavity 21 is formed between the cup body 22 and the liquid outlet pipeline 1; an upper end of the cup base 23 is connected to the inner annular side 2221 of the bottom wall 222, and the cup base 23 is disposed around the liquid outlet pipeline 1. This embodiment is different from the embodiment illustrated in FIG. 5 in that a plurality of coalescence portions 2223 sequentially connected in a circumferential direction are formed between the outer annular side 2222 and the inner annular side 2221 of the bottom wall 222 of the cup body 22.

Figure 9:
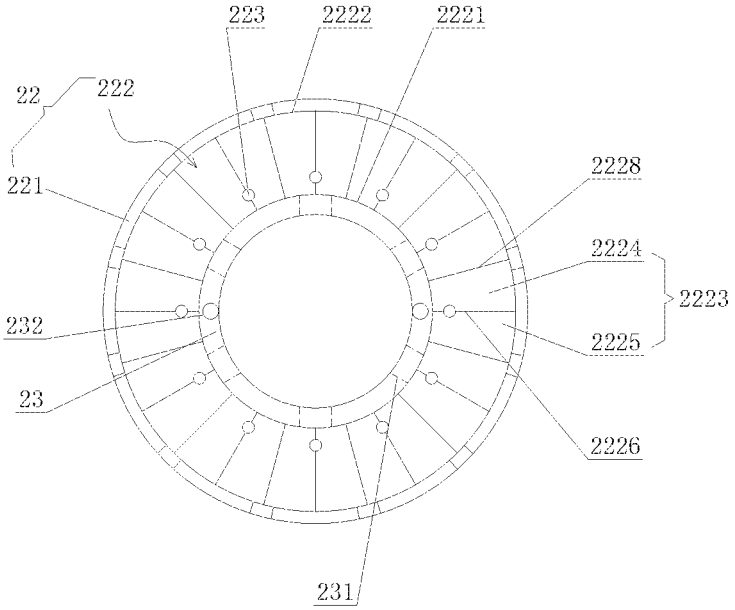
FIG. 9 is a top view of a settling cup illustrated in FIG. 8.

Specifically, referring to FIG. 9, the peripheral wall 221 is formed at the upper end thereof with a serrated outer edge 2211, so as to facilitate the oil drops or bubbles in the liquid to be separated in the cup body 22 to accumulate at and escape from serrated tips, and when the oil drops or bubbles accumulate at the serrated tips of the serrated outer edge 2211, the particle size of the oil drops or bubbles can be significantly increased; the bottom wall 222 is substantially in an annular shape, and as can be seen from the front view of the settling cup 2 illustrated in FIG. 8, a level of the outer annular side 2222 of the bottom wall 222 is higher than a level of the inner annular side 2221 of the bottom wall 222, and the bottom wall 222 is formed by the plurality of coalescence portions 2223 sequentially connected in the circumferential direction of the cup body 22, wherein the coalescence portions 2223 can aggregate and coalesce the oil drops or bubbles in the high water-content crude oil, so that the oil drops or bubbles are aggregated and then coalesced on the lower surface of the bottom wall 222 of the cup body 22 to form large oil drops or large bubbles, thereby increasing the separation velocity and separation efficiency of the oil drops or bubbles; in this embodiment, the bottom wall 222 formed by the coalescence portions 2223 substantially has an annular tile-shaped inclined plate structure.

In the settling cup 2 in this embodiment, due to the plurality of coalescence portions 2223 on the bottom wall 222 of the settling cup 2, the oil drops or bubbles in the high water-content crude oil can be raised to the coalescence portion 2223 and then aggregated and coalesced therein to form large oil drops or bubbles, i.e. to increase the particle size of the oil drops or bubbles, thereby increasing the separation and ascending velocity of the oil drops or bubbles, promoting the separation of the oil drops or bubbles from the water, and realizing the rapid separation of the oil drops or bubbles from the water in the high water-content crude oil.

As illustrated in FIG. 9, the coalescence portion 2223 comprises a first inclined surface 2224 and a second inclined surface 2225, wherein an upper end of the first inclined surface 2224 is connected to an upper end of the second inclined surface 2225 to form an upper inclined flange 2226, an opening 2227 is formed between a lower end of the first inclined surface 2224 and a lower end of the second inclined surface 2225, and an included angle θ is formed between the upper inclined flange 2226 and a horizontal plane; in this embodiment, the included angle θ is 30° to 60°, and the advantage of designing such included angle θ is to facilitate the aggregation and floating of the oil drops or bubbles. A lower inclined flange 2228 is formed between every two adjacently connected coalescence portions 2223, so that the outer annular side 2222 formed by connecting the upper inclined flange 2226 and the lower inclined flange 2228 spaced apart has a serrated shape, which is just matched with the serrated outer edge 2211 at the upper end of the peripheral wall 221 of the cup body 22, so that when the plurality of settling cups 2 are stacked vertically, the outer annular side of the cup body 22-1 of the settling cup 2-1 located above is plugged with the serrated outer edge of the cup body 22-2 of the settling cup 2-2 located below, while forming the gap portions equally spaced apart in the circumferential direction.

In this embodiment, a cross-section of the coalescence portion 2223 is triangular, so that the oil drops or bubbles in the liquid to be separated are aggregated and then coalesced when they move upward and touch the first inclined surface 2224 and the second inclined surface 2225 of the coalescence portion 2223. Since the cross-section of the coalescence portion 2223 is triangular, along with the upward movement of the oil drops or bubbles, the open area decreases, while the concentration increases; the oil drops or bubbles are coalesced after being aggregated to a certain concentration, so that the particle size of the oil drops or bubbles is increased, thereby improving the relative ascending velocity of the oil drops or bubbles and the separation efficiency of the oil drops or bubbles from the water. Of course, in other embodiments, the coalescence portion 2223 can also be designed to have a trapezoidal or arc-shaped cross-section, so long as the cross-section of the coalescence portion 2223 gradually decreases from the opening 2227 to the upper inclined flange 2226, thereby achieving the purpose of aggregating and coalescing the oil drops or bubbles in the coalescence portion 2223.

Figure 10:
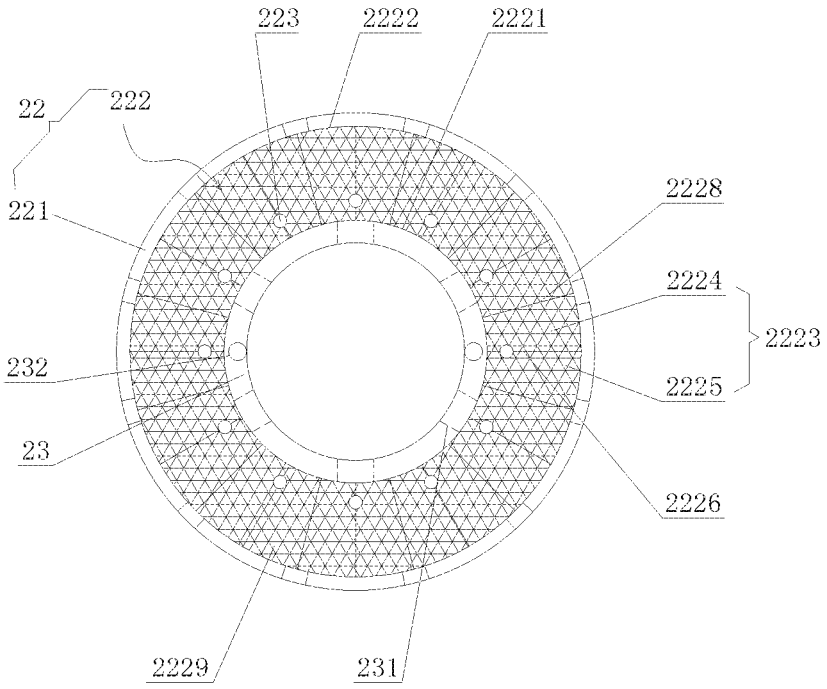
FIG. 10 is a top view of a variant of a settling cup illustrated in FIG. 8.

Further, in this embodiment, as illustrated in FIG. 10, the outer surface of the bottom wall 222 of the settling cup 2 formed by the plurality of coalescence portions 2223 is provided with a plurality of bumps 2229 having a polygonal shape, e.g. triangular, quadrangular or pentagonal structures, which are not limited herein. The bumps 2229 can further achieve the purpose of aggregating and coalescing the oil drops or bubbles in the coalescence portion 2223, so as to improve the separation velocity of the oil drops or bubbles from the liquid.

Figure 11:
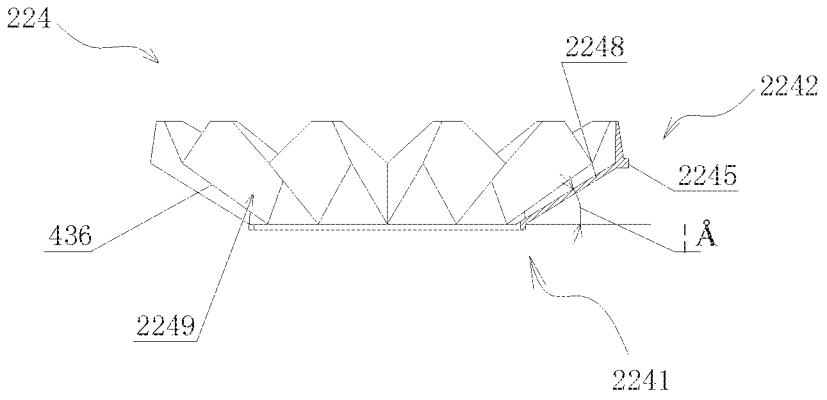
FIG. 11 is a front view of a partition plate of a downhole oil, gas, water and sand separator of the present disclosure.
Figure 12:
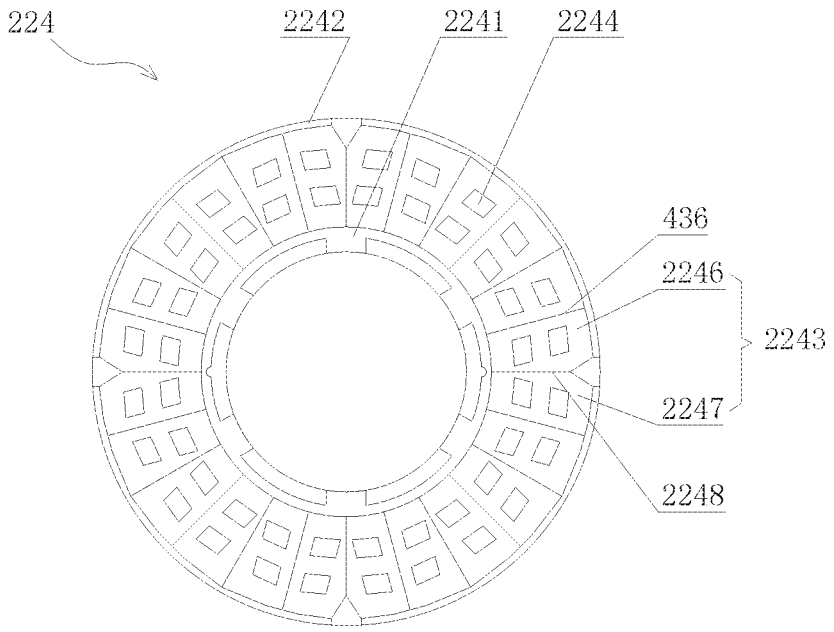
FIG. 12 is a top view of a partition plate of a downhole oil, gas, water and sand separator of the present disclosure.

According to one embodiment of the present disclosure, as illustrated in FIGS. 11 and 12, the cup body 22 of each of the settling cups 2 is provided with a partition plate 224, which is disposed around the liquid outlet pipeline 1, located above the liquid inlet hole group 11 corresponding to the cup body 22 of each of the settling cups 2, and has a partition plate inner annular side 2241 and a partition plate outer annular side 2242, wherein a level of the partition plate outer annular side 2242 is higher than a level of the partition plate inner annular side 2241; and a plurality of partition plate coalescence portions 2243 sequentially connected in a circumferential direction are provided between the partition plate outer annular side 2242 and the partition plate inner annular side 2241, and each of the partition plate coalescence portions 2243 is provided with a plurality of through holes 2244.

Specifically, the partition plate 224 is substantially in a circular shape. As can be seen from the front view of the partition plate 224 illustrated in FIG. 11, a level of the outer annular side 2242 of the partition plate 224 is higher than a level of the inner annular side 2241 of the partition plate 224; the partition plate 224 is formed by a plurality of partition plate coalescence portions 2243 sequentially connected in a circumferential direction thereof, each provided with a plurality of through holes 2244; the partition plate coalescence portion 2243 can aggregate and coalesce the oil drops or bubbles in the high water-content crude oil, so that the oil drops or bubbles are aggregated, collided and coalesced on the lower surface of the partition plate 224 to form large oil drops or large bubbles, thereby increasing the separation velocity and separation efficiency of the oil drops or bubbles; in this embodiment, the partition plate 224 formed by the partition plate coalescence portions 2243 substantially has an annular tile-shaped inclined plate structure.

During usage, the partition plate 224 is placed in an inner cavity 21 of the cup body 22 of each of the settling cups 2, with the inner annular side 2241 being disposed around the liquid outlet pipeline 1, and the outer annular side 2242 provided with a buckling convex portion 2245 protruding radially and outward therefrom; the buckling convex portion 2245 may be a plurality of buckling blocks provided in a circumferential direction, or a buckling ring; the partition plate 224 is engaged into a buckling groove 2212 (see FIG. 8) in the peripheral wall 221 of the cup body 22 of the settling cup 2 through the buckling convex portion 2245, so as to achieve the purpose of fixing the partition plate 224 into the cup body 22 of the settling cup 2, and the partition plate 224 is located above the liquid inlet hole group 11 in the liquid outlet pipeline 1 corresponding to the settling cup 2 where the partition plate 224 is located.

The partition plate 224 adopts the shallow groove principle to relatively reduce the ascending distance of the oil drops or bubbles in the cup body 22 of each of the settling cups 2, so that the oil drops or bubbles in the settling cup 2 ascend for a short distance to contact the partition plate 224; when moving upward and touching the plurality of partition plate coalescence portions 2243 of the partition plate 224, the oil drops or bubbles are aggregated, collided and coalesced on the lower surface of the partition plate 224 to form large oil drops or bubbles, which float above the partition plate 224 from the through holes 2244 thereof and continue moving upward in the settling cup 2 until touching the plurality of coalescence portions 2223 on the bottom wall 222 of the cup body 22 of the settling cup located above this settling cup, and then are aggregated, collided and coalesced again to form further larger oil drops or bubbles, thereby further increasing the floating velocity of the oil drops or bubbles, and the rapidly floating oil drops or bubbles are discharged out of the downhole oil, gas, water and sand separator 10 to realize an efficient oil-gas separation.

The partition plate 224 relatively reduces the ascending distance of the oil drops or bubbles in each of the settling cups by means of the plurality of partition plate coalescence portions 2243 on the partition plate 224, so that the oil drops or bubbles first collide and are coalesced with each other on the plurality of partition plate coalescence portions 2243 on the partition plate 224, to form large oil drops or bubbles, which then ascend to the coalescence portions 2223 on the bottom wall of the settling cup located above and collide and are coalesced with each other. The arrangement of the partition plate 224 can effectively increase the separation and ascending velocity of the oil drops or bubbles from the water, further promote the separation of the oil drops or bubbles from the water, and realize the rapid separation of the oil drops or bubbles from the water in the high water-content crude oil.

In this embodiment, the partition plate coalescence portion 2243 comprises a partition plate first inclined surface 2246 and a partition plate second inclined surface 2247; a plurality of through holes 2244 are provided in the partition plate first inclined surface 2246 and the partition plate second inclined surface 2247, respectively; an upper end of the partition plate first inclined surface 2246 is connected to an upper end of the partition plate second inclined surface 2247 to form a partition plate upper inclined flange 2248; a partition plate opening 2249 is formed between a lower end of the partition plate first inclined surface 2246 and a lower end of the partition plate second inclined surface 2247; a partition plate included angle ε is formed between the partition plate upper inclined flange 2248 and a horizontal plane; in this embodiment, the partition plate included angle ε is 30° to 60°, and the advantage of designing such included angle ε is to facilitate the aggregation and floating of the oil drops or bubbles, wherein the total number of the partition plate lower inclined flanges 436 and the partition plate upper inclined flanges 2248 on the partition plate 224 may be 6 to 12.

In this embodiment, a cross-section of the partition plate coalescence portion 2243 is triangular, so that the oil drops or bubbles in the liquid to be separated are aggregated when moving upward and touching the partition plate first inclined surface 2246 and the partition plate second inclined surface 2247 of the partition plate coalescence portion 2243; since the cross-section of the partition plate coalescence portion 2243 is triangular, when the oil drops or bubbles move upward, the open area decreases and the concentration increases; after being aggregated to a certain concentration, the oil drops or bubbles are coalesced to increase the particle size of the oil drops or bubbles, further improve the relative ascending velocity of the oil drops or bubbles and the separation efficiency of the oil drops or bubbles from the water. Of course, in other embodiments, the partition plate coalescence portion 2243 may also be designed to have a trapezoidal or arc-shaped cross-section, so long as the cross-section of the partition plate coalescence portion 2243 gradually decreases from the partition plate opening 2249 to the partition plate upper inclined flange 2248, thereby achieving the purpose of aggregating and coalescing the oil drops or bubbles in the partition plate coalescence portion 2243.

According to one embodiment of the present disclosure, the accommodating cavity 21 of the cup body 22 of each of the settling cups 2 is filled with a filter material, which is a porous medium capable of changing wettability, such as oleophilic quartz sand or coated quartz sand, etc. Through the principle of phase infiltration, when the oil drops in the high water-content crude oil flow through the filter material, the small oil drops become oil films; as the upward pressure gradient that the oil films undergo is larger than the downward pressure gradient that the oil films undergo, the oil films slide upward in the filter material; since the oil films are adsorbed on the pore surfaces in the porous medium which has a pressure gradient from bottom to top, the oil films float out of the filter material under the influence of the pressure gradient, and the remaining liquid directly sinks to the bottom of the accommodating cavity through the porous medium; and the oil films form large oil drops at the outlet of the porous medium, so that the floating velocity is faster, and the separation efficiency is improved.

The downhole oil, gas, water and sand separator 10 can effectively perform the downhole oil, gas, water and sand separation. The separated produced liquid can be extracted through the liquid outlet pipeline 1 and directly injected back to other oil layers, and the high oil-content liquid is produced to the ground through the oil well pump. The downhole oil, gas, water and sand separator 10 can greatly improve the pump efficiency while performing the gas-liquid separation. In addition, the separation of gravels from the produced liquid also relatively prolong the working life of the downhole oil, gas, water and sand separator 10 and the oil well pump.

The specific working process of the downhole oil, gas, water and sand separator 10 is as follows:

The oil well pump is started, and the crude oil in the oil jacket annulus 31 is injected into each of the settling cups 2 through a plurality of liquid inlets 24 of the downhole oil, gas, water and sand separator 10; after the crude oil in the oil jacket annulus 31 is divided into a plurality of parts, a gas-liquid separation is performed in the cup body 22 of each of the settling cups 2; the separated produced liquid flows into the liquid outlet pipeline 1 through a plurality of liquid inlet holes 111 of each of the liquid inlet hole groups 11 in the liquid outlet pipeline 1; the separated gas and/or oil drops are discharged out of the downhole oil, gas and water and sand separator 10 through the plurality of liquid inlets 24; and the separated sand is discharged out of the settling cups through a plurality of sand outlet holes 223.

Those embodiments described above are just several embodiments of the present disclosure, and a person skilled in the art can make various changes or modifications to the embodiments of the present disclosure according to the disclosure of the application document without departing from the spirit and scope of the present disclosure.

The invention claimed is:

1. A downhole oil, gas, water and sand separation method, comprising:

(Step 1:) dividing an oil jacket annulus into a plurality of spaces in an outflow direction of a produced liquid, wherein each of the plurality of spaces are provided with an accommodating cavity communicated with the oil jacket annulus, so that crude oil in the oil jacket annulus is divided into a plurality of parts which flow into a plurality of accommodating cavities, respectively, a descending velocity of liquid in crude oil in each of the accommodating cavities is decreased relative to a descending velocity of liquid in the crude oil in the oil jacket annulus, and an ascending velocity of oil drops or bubbles in the crude oil in each of the accommodating cavities is increased relative to an ascending velocity of oil drops or bubbles in the crude oil in the oil jacket annulus;

(Step 2:) arranging a plurality of liquid inlet hole groups in a liquid outlet pipeline of the produced liquid in the outflow direction of the produced liquid, wherein each of the plurality of liquid inlet hole groups are communicated with one of the accommodating cavities; and (Step 3:) separating oil, gas and water after the crude oil in the oil jacket annulus flows into each of the accommodating cavities, wherein separated oil drops or bubbles flow back to the oil jacket annulus from the accommodating cavities, and separated produced liquid simultaneously flows into the liquid outlet pipeline through the plurality of liquid inlet hole groups, wherein step 3 comprises:

determining pressure differences in the oil jacket annulus and the liquid outlet pipeline according to liquid production capacities of different oil wells, areas of different oil jacket annuluses, and an area of the liquid outlet pipeline; and adjusting open areas of the liquid inlet hole groups at different positions in the liquid outlet pipeline according to the pressure differences, so that flow rates of the produced liquid simultaneously flowing into the liquid outlet pipeline through each of the liquid inlet hole groups are equal.

2. The downhole oil, gas, water and sand separation method according to claim 1, wherein a number N of the accommodating cavities is calculated according to the following formula:

$$N = \frac{QT_t}{86400V}$$

wherein:

Q is a liquid production capacity of an oil well;

$T_t$ is expected residence time of the crude oil in the accommodating cavity; and V is a volume of the accommodating cavity.

3. The downhole oil, gas, water and sand separation method according to claim 2, wherein the expected residence time $T_t$ of the crude oil in the accommodating cavity is 25 s to 150 s.

4. The downhole oil, gas, water and sand separation method according to claim 2, wherein the volume V of the accommodating cavity is 50 ml to 250 ml.

5. The downhole oil, gas, water and sand separation method according to claim 1, wherein in step 2, each of the plurality of liquid inlet hole groups comprises a plurality of liquid inlet holes spaced apart in a circumferential direction of the liquid outlet pipeline, and a diameter d of the liquid inlet hole is calculated according to the following formula:

$$d = \sqrt[4]{\frac{20\rho q^2}{\Delta p \pi^2}}$$

wherein:

q is a flow rate of the produced liquid flowing through the liquid inlet hole;

p is a density of the produced liquid; and

Δp is a pressure difference between an interior and an exterior of the liquid outlet pipeline.

6. The downhole oil, gas, water and sand separation method according to claim 5, wherein the pressure difference Δp between the interior and the exterior of the liquid outlet pipeline is calculated according to the following formula:

$$\Delta p = 1.25\rho v^2$$

wherein v is a flow velocity of the produced liquid passing through the liquid inlet hole.

7. The downhole oil, gas, water and sand separation method according to claim 5, wherein the flow rate q of the produced liquid flowing through the liquid inlet hole is calculated according to the following formula:

$$q = \frac{Q}{Nn}$$

wherein:

Q is a liquid production capacity of an oil well;

N is a number of the accommodating cavities; and n is a number of the liquid inlet holes in each of the liquid inlet hole groups.

8. The downhole oil, gas, water and sand separation method according to claim 1, wherein a distance between every adjacent two of the liquid inlet hole groups is 10 mm to 55 mm.

9. The downhole oil, gas, water and sand separation method according to claim 1, further comprising:

(Step 4:) placing a filter material in each of the accommodating cavities, so that the oil drops in the crude oil become oil films when flowing through the filter material, and an upward pressure gradient that the oil films undergo in the filter material is larger than a downward pressure gradient that the oil films undergo, thereby promoting the oil films to slide upward in the filter material.

10. The downhole oil, gas, water and sand separation method according to claim 1, wherein the accommodating cavity is provided with a plurality of sand outlet holes communicated with the oil jacket annulus.

11. A downhole oil, gas, water and sand separator, comprising:

a liquid outlet pipeline provided with a plurality of liquid inlet hole groups spaced apart in an axial direction thereof; and a plurality of settling cups connected to each other and disposed around the liquid outlet pipeline, each having an accommodating cavity communicated with each of the liquid inlet hole groups, and having a liquid inlet and a plurality of sand outlet holes;

wherein the settling cup comprises:

a cup body having a peripheral wall and a bottom wall, wherein the bottom wall has an inner annular side and an outer annular side, a lower end of the peripheral wall is connected to the outer annular side of the bottom wall, a level of the outer annular side is higher than a level of the inner annular side, and the accommodating cavity is formed between the cup body and the liquid outlet pipeline; and a cup base having an upper end connected to the inner annular side of the bottom wall, and disposed around the liquid outlet pipeline.

12. The downhole oil, gas, water and sand separator according to claim 11, wherein the downhole oil, gas, water and sand separator is located in a downhole casing, the liquid outlet pipeline is connected to an oil pipe provided in the downhole casing, and an oil jacket annulus formed between the downhole casing and the oil pipe is communicated with the accommodating cavity through the liquid inlet.

13. The downhole oil, gas, water and sand separator according to claim 11, wherein each of the plurality of liquid inlet hole groups comprises a plurality of liquid inlet holes spaced apart in a circumferential direction of the liquid outlet pipeline, and a diameter of the liquid inlet hole located at a liquid outlet end of the liquid outlet pipeline is larger than a diameter of the liquid inlet hole located at a tail end of the liquid outlet pipeline.

14. The downhole oil, gas, water and sand separator according to claim 11, wherein the settling cup is provided therein with a filter material box, which is disposed around the liquid outlet pipeline, located at a downstream end of one of the liquid inlet hole groups correspondingly communicated with each of the accommodating cavities in an outflow direction of produced liquid, and provided therein with a filter material.

15. The downhole oil, gas, water and sand separator according to claim 11, wherein the cup body of each of the settling cups is provided therein with a partition plate, which is disposed around the liquid outlet pipeline, located above the liquid inlet hole group corresponding to the cup body of each of the settling cups, and has a partition plate inner annular side and a partition plate outer annular side, wherein a level of the partition plate outer annular side is higher than a level of the partition plate inner annular side; and a plurality of partition plate coalescence portions sequentially connected in a circumferential direction are provided between the partition plate outer annular side and the partition plate inner annular side, and each of the partition plate coalescence portions are provided with a plurality of through holes.

16. The downhole oil, gas, water and sand separator according to claim 15, wherein the partition plate coalescence portion comprises a partition plate first inclined surface and a partition plate second inclined surface; an upper end of the partition plate first inclined surface is connected to an upper end of the partition plate second inclined surface to form a partition plate upper inclined flange; a partition plate opening is formed between a lower end of the partition plate first inclined surface and a lower end of the partition plate second inclined surface; and a partition plate included angle is formed between the partition plate upper inclined flange and a horizontal plane.

17. The downhole oil, gas, water and sand separator according to claim 16, wherein the partition plate included angle is 30° to 60°.

18. The downhole oil, gas, water and sand separator according to claim 11, wherein a plurality of coalescence portions sequentially connected in a circumferential direction are formed between the outer annular side and the inner annular side.

19. The downhole oil, gas, water and sand separator according to claim 18, wherein the coalescence portion comprises a first inclined surface and a second inclined surface;

an upper end of the first inclined surface is connected to an upper end of the second inclined surface to form an upper inclined flange, an opening is formed between a lower end of the first inclined surface and a lower end of the second inclined surface, and an included angle is formed between the upper inclined flange and a horizontal plane.

20. The downhole oil, gas, water and sand separator according to claim 19, wherein the included angle is 30° to 60°.

21. The downhole oil, gas, water and sand separator according to claim 18, wherein a serrated outer edge is formed at an upper end of the peripheral wall, and a shape of the serrated outer edge is matched with a shape of the outer annular side of the bottom wall of the cup body.

22. The downhole oil, gas, water and sand separator according to claim 11, wherein a lower end of the cup base is provided with a plurality of positioning pins protruding therefrom, the upper end of the cup base is provided with a plurality of positioning holes, the positioning pins and the positioning holes are oppositely and vertically disposed, and every adjacent two of the settling cups are connected to each other by inserting the positioning pins of one of the settling cups into the positioning holes of the other of the settling cups.

23. The downhole oil, gas, water and sand separator according to claim 11, wherein a lower end of the cup base is provided with a plurality of opening grooves spaced apart in a circumferential direction to open into the liquid inlet hole groups.

24. The downhole oil, gas, water and sand separator according to claim 11, wherein a gap portion is formed between every adjacent two of the cup bodies, and the gap portion is the liquid inlet of the settling cup.

* * * * *